US005274301A

United States Patent [19]

Takahashi et al.

[11] Patent Number: 5,274,301

[45] Date of Patent: Dec. 28, 1993

[54] COLOR CATHODE RAY TUBE PANEL WITH SHADOW MASK SUPPORTS

[75] Inventors: Tohru Takahashi, Fukaya; Michio Nakamura, Kamisato; Takeshi Fujiwara, Kumagaya; Hidenari Toge, Ibo, all of Japan; Hidetoshi Yamazaki, Dusseldorf, Fed. Rep. of Germany

[73] Assignee: Kabushiki Kaisha Toshiba, Kawasaki, Japan

[21] Appl. No.: 951,038

[22] Filed: Sep. 24, 1992

Related U.S. Application Data

[63] Continuation-in-part of Ser. No. 829,587, Feb. 3, 1992, abandoned, which is a continuation of Ser. No. 453,344, Dec. 22, 1989, abandoned, which is a continuation of Ser. No. 149,079, Jan. 27, 1988, abandoned.

[30] Foreign Application Priority Data

Jan. 27, 1987 [JP] Japan ..... 62-15226
Dec. 23, 1987 [JP] Japan ..... 62-323733

[51] Int. Cl.[5] ..... H01J 29/07
[52] U.S. Cl. ..... 313/406; 313/477 R
[58] Field of Search ..... 313/406, 477 R, 482

[56] References Cited

U.S. PATENT DOCUMENTS

| | | | |
|---|---|---|---|
| 2,928,967 | 3/1960 | Pfaender . | |
| 3,004,182 | 10/1961 | Pfaender | 313/406 X |
| 3,529,199 | 9/1970 | Duistermaat et al. | 313/406 |
| 3,832,592 | 8/1974 | Yamazaki | 313/404 |
| 4,271,345 | 6/1981 | Palmer et al. | 445/30 X |
| 4,333,033 | 6/1982 | Gordingley et al. | 313/406 X |
| 4,355,260 | 10/1982 | Dougherty | 313/406 X |

FOREIGN PATENT DOCUMENTS

| | | | |
|---|---|---|---|
| 45-27183 | 9/1970 | Japan . | |
| 46-25396 | 7/1971 | Japan . | |
| 48-18429 | 5/1973 | Japan . | |
| 0069377 | 6/1979 | Japan | 313/406 |
| 59-59861 | 5/1984 | Japan . | |
| 62-58547 | 3/1987 | Japan . | |
| 1195804 | 6/1970 | United Kingdom . | |

*Primary Examiner*—Palmer C. Demeo
*Attorney, Agent, or Firm*—Cushman, Darby & Cushman

[57] ABSTRACT

In a panel for a color cathode ray tube, a faceplate is so formed as to have a substantially rectangular front view and a skirt has four corner sections. Panel pin mount bases are provided on the four corner sections of the skirt, respectively and four panel pins are fixed to the mount base, respectively.

4 Claims, 2 Drawing Sheets

COLOR CATHODE RAY TUBE PANEL WITH SHADOW MASK SUPPORTS

This is a continuation-in-part of application Ser. No. 07/829,587, filed on Feb. 3, 1992, which was abandoned upon the filing hereof which, in turn, is a continuation of application Ser. No. 07/453,344, filed Dec. 22, 1989, now abandoned, which, in turn, is a continuation of application Ser. No. 07/149,079, filed Jan. 27, 1988, now abandoned.

BACKGROUND OF THE INVENTION

This invention relates to a color cathode ray tube and more particularly to a color cathode ray tube panel having an improved panel pin mounting construction for supporting a shadow mask.

Generally, in a color cathode ray tube, panel pins for supporting a shadow mask are fixed to a panel. Normally, the panel pins are fixed on the skirt of the panel. In fixing on the panel skirt, there are two methods: one is that the panel pins are fixed embedded at about the center points of four inner side sections of the skirt and the other is that the panel pins are fixed embedded at four corner sections of the skirt as disclosed in U.S. Pat. No. 4,652,792.

As described in U.S. Pat. No. 4,652,792, in the latter fixing method, a mask frame of a substantially rectangular shadow mask is supported, through elastic support members, by the panel pins at four corners and the mask frame is subject to less deformation than in the former fixing method in which the mask frame is supported at the center portions of its four sides. Hence, the latter method provides less chances for electron beams to be mislanded on the screen, particularly at the corner areas in completed cathode ray tubes.

Since a mask frame of a substantially rectangular shadow mask is supported, through elastic support members, by panel pins at four corners, the shadow mask is less liable to vibrate when an external impact is given to the shadow mask, thus reducing variations in beam landing caused by vibration. Mask frames used for the latter fixing method, having stability against vibration, can be made thinner than mask frames adopted for the former method.

As disclosed in U.S. Pat. No. 4,652,792, it is possible to correct, without using a bimetal that is conventionally installed in a cathode ray tube. a long time purity drift phenomenon which appears more than 30 minutes after the cathode ray tube is energized.

It has been pointed out, however, that the fixing method, in which panel pins are embedded at four corner sections and which has various advantages described above, involves the following problems.

Generally, panel pins are integral bodies, each consisting of a taper section connected with an elastic support member and a cylindrical embedded section to be embedded in a corner of a panel, leaving the taper section projecting. When such a panel pin is embedded at corner, the embedded section cannot be embedded in the corner section to a uniform depth around its periphery because the inner surface of the corner section is curved. The result is an insufficient embedded strength of panel pins.

With cathode ray tubes named FS tube (tradename) which are disclosed in U.S. Pat. Nos. 4,537,321, 4,537,322 and 4,535,907 and Ser. No. 844,553 filed on Mar. 28, 1986, the curvature of the corner sections of the panel is large in every case, resulting in low mounting strength and low embedding accuracy of the panel pins. In large-size cathode ray tubes, the weight of the shadow mask is so great as to liable to impose a large load on the panel pins and therefore, the panel pins are required to have a high mounting strength.

With the construction in which panel pins are embedded at the corner sections of a panel, however, a sufficient mounting strength cannot be obtained for the panel pins. Therefore, there is a possibility that a crack occurs at the corners where panel pins are embedded, due to a thermal shock applied to the panel or a mechanical shock in mounting or dismounting a shadow mask during the manufacturing process of cathode ray tubes.

Since panel pins are embedded in curved corner sections, four panel pins cannot be positioned with accuracy so high as in embedding in flat skirt sections. Panel pins tend to be mounted off specified positions or a specified angle. If the panel pins are mounted with poor accuracy, a shadow mask cannot be held in correct position by panel pins. Consequently, phosphor stripes, which are formed by exposure through apertures of a shadow mask, cannot be arranged in correct position, deteriorating color reproducibility or making color adjustment difficult in a completed color cathode ray tube. In a structure in which the panel pins are embedded at the corner sections such that the panel pins are incorrectly inclined or positioned, the embedded depth is more uneven around their peripheries and therefore, the embedded strength is more reduced.

Generally, panels are molded by pressing molten glass in a mold. In the press molding process, a plunger that presses molten glass is pulled out of the mold before the molten glass solidifies, that is to say, an unsolidified glass panel comes out of the mold, thus entailing a possibility that the skirt of the glass panel inclines slightly either inside or outside. This slight inclination of the skirt is liable to deteriorate the mounting accuracy. To avoid this, delicate adjustments are required.

For example, if the skirt of a glass panel is inclined slightly inside, panel pins need to be embedded in the skirt deeper than normally in order to secure specified diagonal dimensions between two pairs of diagonally opposite panel pins. Similarly, if the skirt of a glass panel is inclined slightly outside, panel pins need to be embedded in the skirt shallower than normally in order to secure specified diagonal dimensions between two pairs of diagonally opposite panel pins.

When the skirt of a glass panel is inclined slightly inside, panel pins are embedded in the skirt deeper than normally, resulting in glass rising along the peripheries of the panel pins when the molten glass solidifies and offering a possibility that the risen glass having a strain is scarred by elastic support members fixed to a shadow mask when the shadow mask is fitted to the panel pins or detached from the panel pins. If a glass panel is scarred, cracks may develop in the glass panel due to a thermal shock applied during the manufacturing process of color cathode ray tubes.

When the skirt of a glass panel is inclined slightly outside, panel pins are embedded in the skirt shallower than normally, reducing the mounting strength of panel pins and increasing a possibility of cracks developing in the glass panel by a thermal or mechanical shock.

When panel pins are mounted at corners of a panel, a phosphor slurry, which is introduced into the panel to form a phosphor screen, is likely to adhere to the panel pins. If this happens, the deposited phosphor will fall off and adhere to electrodes of an electron gun, for example, in the tube, thus deteriorating the dielectric strength during the manufacturing process or after completion of the cathode ray tube.

A phosphor screen is made as follows. A glass panel is rotated, a phosphor slurry is introduced to the substantially central portion of the rotating panel, the phosphor slurry is spread along the inner surface of the faceplate by the use of centrifugal force and excess phosphor slurry that has reached the skirt is collected from the skirt. In this process, the excess phosphor slurry collects at the corners of the panel where the centrifugal force acts greatest and is discharged from the corners to the outside of the panel.

In FS type color cathode ray tubes with a rectangular screen, which are the dominant type in the market, the skirt is sharp-cornered, making phosphor slurry concentrate at the corners and increasing the possibility of its adhering to the panel pins. The phosphor slurry adhering to the panel pins deteriorates the repeatability of shadow mask mounting operations and, if it falls off, decreases the dielectric strength of the color cathode ray tube.

As described above, in color cathode ray tubes for which panel pins are mounted at corners of a skirt of a substantially rectangular panel and a shadow mask is installed between the panel pins by connecting elastic support members to the panel pins, the basic problem is that the embedding depth of a panel pin is uneven around its periphery. Therefore, the mounting strength of panel pins is lower than in ordinary color cathode ray tubes in which panel pins are embedded at center points of four sides of the skirt. Worse still, the mounting accuracy decreases.

In addition, when panel pins are installed off specified mounting positions or angle and the skirt is inclined outside by press molding, the mounting accuracy is reduced still lower. As color cathode ray tubes become larger, the shadow mask increases in weight, increasing a load on the panel pins. When the load on the panel pins increases, there are increased chances for cracks to occur around the panel pins by a thermal or mechanical shock during the manufacturing process of color cathode ray tubes.

When the skirt is inclined in press molding, a rise of glass around the panel pins increases. As a result, the risen portions are scratched when they are contacted by the elastic support members in mounting and dismounting the shadow mask. The scratches may lead to the occurrence of cracks by a thermal shock applied in the manufacturing process of color cathode ray tubes. Even if scratches or cracks are minute, stresses and resulting strains occur in a cathode ray tube, particularly at the corners when the air is purged from the tube and the tube is subjected to atmospheric pressure. Then, the minute cracks will develop and result in an implosion when worst comes to worst.

With panels in which panel pins are mounted at the corners of the skirt, excess phosphor slurry is discharged from the corners when a phosphor screen is formed. The phosphor which adheres to the panel pins impairs the repeatability of shadow mask mounting operations. Later, the deposited phosphor comes off and deteriorates the dielectric strength of the color cathode ray tube.

SUMMARY OF THE INVENTION

This invention relates to a color cathode ray tube in which panel pins are mounted at the corners of a skirt of a panel substantially rectangular in the front view and the panel pins are used to secure a shadow mask. The object of this invention is to provide a color cathode ray tube of the above-mentioned constructional type which has been improved in the mounting strength and accuracy of panel pins and which has a constructional feature to prevent phosphor from adhering to the panel pins when a phosphor screen is formed.

According to this invention, the panel construction of a color cathode ray tube comprises a faceplate having curved outer and inner surfaces, a front view of said inner surface on which a phosphor layer is formed being substantially rectangular; a skirt with some thickness extending from a peripheral edge of said faceplate and having four corner sections, each of said corner sections being provided with a mount base so as to be thicker than said skirt and having an outer surface curved with some curvature and an inner surface defined as a surface of the mount base, the curvature of which is smaller than the curvature of the outer surface; four panel pins fixed to corresponding mount bases of said skirt, said panel pins projecting in diagonal directions of said faceplate; and a shadow mask supported by said four panel pins.

DETAILED DESCRIPTION OF THE PREFERRED EMBODIMENTS

Figure 1:
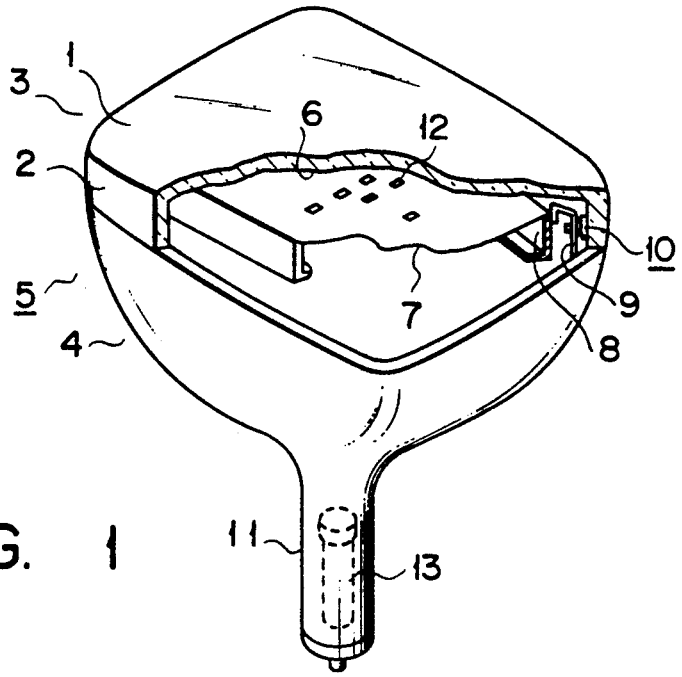
FIG. 1 is a partially cutaway view in perspective of a cathode ray tube to which a panel pin mounting construction according to an embodiment of this invention is applied.
Figure 2:
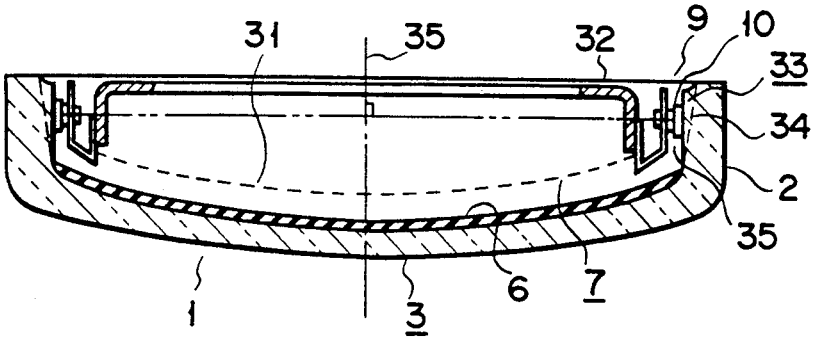
FIG. 2 is a sectional view of the panel and shadow mask of FIG. 1.

FIG. 1 shows a color cathode ray tube incorporating a panel pin mounting construction according to an embodiment of this invention. As is well known, envelope 5 of a color cathode ray tube is made of glass and includes neck 11 which accommodates electron gun 13, funnel 4 which has an opening extending from neck 11 and panel 3 which is fusion-joined to the opening of funnel 4. Referring to FIGS. 1 and 2, panel 3 has faceplate 1 and skirt 2 extending from a peripheral edge of faceplate 1 to funnel 4 and faceplate 1 has formed on its inner surface screen 6 consisting of a three color phosphor layer.

Shadow mask 7, which is of a substantially rectangular shape, is arranged in panel 3 to oppose phosphor screen 6. Shadow mask 7 comprises mask section 31 having a large number of apertures of specified shape for allowing passage of electron beams therethrough and frame 32 having an L-like cross section and extending from a peripheral edge of shadow mask 7. Shadow mask 7 is mounted to panel 3 by connecting elastic support members 9, which has a substantially U-like cross section and fixed at corners of an outer peripheral wall of frame 32, to panel pins 10 secured at corners of skirt 2. For details of elastic support members 9, refer to U.S. Pat. No. 4,652,792.

Figure 3:
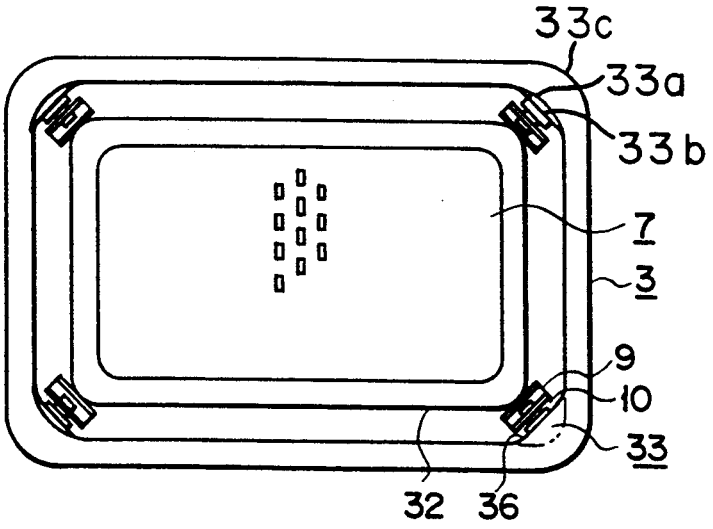
FIG. 3 is a top view of the panel and shadow mask of FIG. 2.
Figure 4:
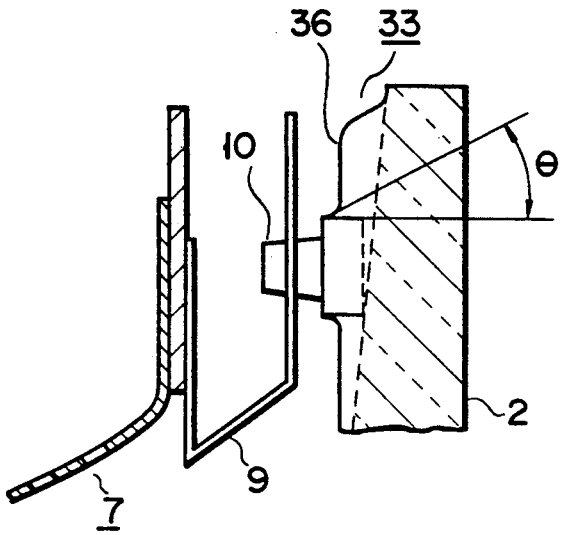
FIG. 4 is a side view showing a construction of mounting the shadow mask of FIGS. 2 and 3 to a panel pin through an elastic support member.
Figure 5:
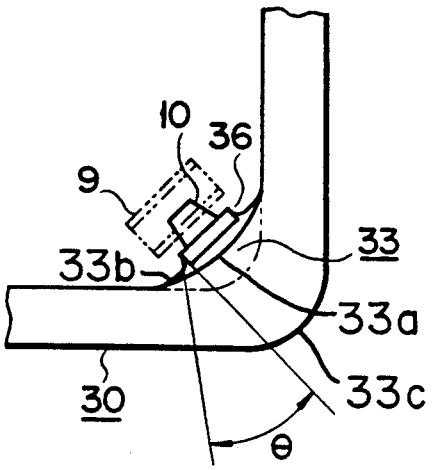
FIG. 5 is a top view showing a construction of mounting the panel pin shown in FIGS. 2 through 4.

In this color cathode ray tube, mount bases 33 are formed on the corners of skirt 2 of panel 3, respectively. In this embodiment, each mount base 33 has an inner peripheral surface 33A and a flat base surface 33B. The inner peripheral surface 33A is formed such that an inner curvature Ri of the inner peripheral surface 33A is larger than an outer curvature Ro of an outer peripheral surface 33C of the skirt 2. Thus, the inner peripheral surface 33A allows two substantially flat inner side surfaces of the skirt 2 to be smoothly and continuously coupled. The flat base surface 33B is so formed as to be parallel to the panel axis and have a cross-sectional area slightly larger than the area of an embedded section of a panel pin 10. In this embodiment, each mount base 33 has a substantially triangular cross section, formed by two sides of a corner of skirt 2. As indicated by the broken line in FIG. 2, each mount base 33 extends from the point of border between faceplate 1 and skirt 2 toward the opening in almost parallel with the panel axis (which is coincident with the tube axis) in contrast to the sloped peripheral inner surface of skirt 2 other than the positions of the panel pin mount bases as shown in FIG. 3. Therefore, at the opening end of the panel, the end portions of the mount bases project toward the center of panel 3. Each panel pin mount surface 36 is formed such that it intersects almost perpendicularly to the axis of panel pin 10 when panel pin 10 is mounted correctly.

Panel pins 10 are installed by melting the specified positions of panel pin mount bases 33 with a gas burner or by high frequency heating and embedding them in the melted positions.

If panel mount bases 33 having mount surfaces 36 which intersect almost perpendicularly to the axes of panel pins 10 are provided at the corners of skirt 2 of panel 3 as described above, it is possible to change the flow of excess phosphor slurry discharged from the corners of skirt 2 during the formation of a phosphor screen to thereby prevent the phosphor from adhering to panel pins 10.

By the above construction, the surface area of panel pin mount surface 36 shown in FIG. 3 is wider than in the conventional constructions, making the phosphor slurry flow diffused as if moving away from the panel pins 10. Further, boundary lines are formed between mount surface 36 and sides of the panel. The phosphor slurry flows concentratedly through the thus formed boundary corners and this also serves to prevent the adhesion of the phosphor slurry to panel pins 10. Therefore, it is possible to prevent a deterioration in repeatability of shadow mask mounting operations due to the adhesion of phosphor slurry.

By the use of the above construction, panel pins 10 can be easily embedded uniformly around their peripheries to a fixed depth and with a wetting angle of preferably 40° at which the embedded strength is greatest. Thus, the mounting strength of panel pins 10 can be obtained which is higher than in the conventional mounting constructions. The provision of slightly curved or almost flat mount bases as described above reduces the deformation of the corners of skirt 2 during the formation of panel 3.

Since panel pin mount bases 33 each have a flat surface, panel pins 10 can be embedded to any desired depth using this flat surface as the reference face. Hence, the mounting accuracy is high, ensuring high repeatability of mounting and dismounting operations of shadow masks. As a result color cathode ray tubes which display good-quality pictures can be produced. The improved mounting accuracy stabilizes the embedded depth of panel pins 10, thereby preventing cracks that used to occur owing to the low mounting accuracy of the panel pins. The provision of flat mount bases 33 makes it possible to increase the thickness of the corners of the panel, which offers a higher strength to the panel to guard against its deformation by atmospheric pressure. As a result, color cathode ray tubes having high strength against implosion of the envelope can be produced.

Figure 6:
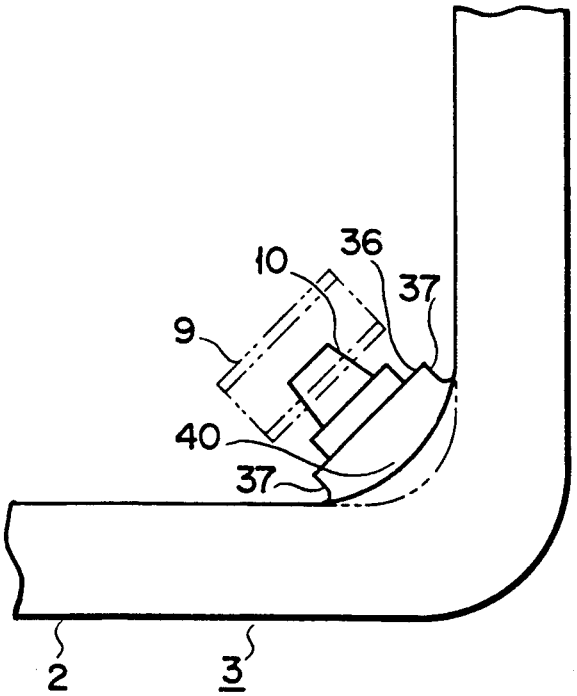
FIG. 6 is a top view showing a panel pin mounting construction according to another embodiment of this invention.

Some modifications will now be described in the following. Referring to FIG. 6, there is formed at the corner of skirt 2 of panel 3, mount base 40 to provide recesses 37 between panel pin mount surface 36 and the inner surface of skirt 2, in addition to panel pin mount surface 36. The formation of mount base 40 of this configuration makes it possible to effectively limit the passage of excess phosphor slurry coming out of the corners during the formation of a phosphor screen, providing less chances for the phosphor to adhere to panel pins 10.

The embedding accuracy and strength of panel pins 10 can be improved if they are embedded in such a way that the center axes of panel pins intersect tube axis 35 at right angles.

With the above construction, it is possible to obtain higher mounting accuracy and strength of the panel pins and prevent panel cracking and phosphor adhesion to the panel pins. Therefore, an improved repeatability of mounting and dismounting operations of shadow masks can be obtained, thus ensuring that color picture tubes are capable of displaying good-quality color images.

The panel pin mount construction according to this invention should preferably be applied particularly to color cathode ray tubes disclosed in U.S. Pat. Nos. 4,537,321, 4,537,322 and 4,535,907. By so doing, the above-described advantages can be obtained securely.

What is claimed is:

1. A color cathode ray tube panel, comprising:

a faceplate having a peripheral edge and first and second surfaces, said faceplate being substantially rectangular, and having a tube axis that is perpendicular to a plate tangential to a central portion of said faceplate;

a phosphor layer formed on said first surface of said faceplate;

a skirt extending, at a substantially right angle to said first surface, from the peripheral edge of said first surface, said skirt having four corner sections proximate the corners of said faceplate, said skirt having inner and outer surfaces;

said skirt inner surface, at said corner sections, having a smaller radius of curvature, in a plane perpendicular to said axis, than the outer surface of said skirt, said skirt inner surface also having a mount base formed thereon at each of said corner sections so as to create a portion of said skirt, at said corner sections, that is thicker than the remaining portions of said skirt, a surface of each of said mount bases forming a substantially continuous curve with said skirt inner surface and said first surface;

one panel pin being uniformly imbedded in, and fixed to, each of said mount bases, said panel pins extending from the inner surface of said mount bases towards said axis;

a shadow mask having apertures and facing said phosphor layer;

support members, each having a substantial U-like cross-section, fixed to said shadow mask and coupled to the corresponding pin; and said mount base including an inner peripheral curved surface and a flat base surface, said inner peripheral surface having a curvature larger than a curvature of an outer peripheral surface of said skirt; and an area of said flat base surface being slightly larger than the area of an embedded section of a panel pin, said flat base surface being substantially parallel to a panel axis and a tube axis.

2. A color cathode ray tube according to claim 1 wherein each of said mount base surfaces is a substantially flat surface lying in a plane substantially at a right angle to a diagonal of said faceplate.

3. A color cathode ray tube according to claim 1 wherein each of said four panel pins has an axis perpendicular to said axis of the tube.

4. A color cathode ray tube according to claim 1 wherein said panel pin is fixed to said mount base at a wetting angle of approximately 40°.

* * * * *